United States Patent [19]

Kumata et al.

[11] Patent Number: 4,661,034

[45] Date of Patent: Apr. 28, 1987

[54] BAR-LIKE MEMBER SUPPLYING METHOD AND DEVICE

[75] Inventors: Katsuhiko Kumata; Isao Endo, both of Nagareyama; Syozi Numa, Tokyo; Ichiro Hirose; Takayoshi Sagawa, both of Hiratsuka; Katsuyoshi Matono, Fukuoka, all of Japan

[73] Assignees: Tokyo Automatic Machinery Works, Ltd.; Japan Tobacco, Inc., both of Tokyo, Japan

[21] Appl. No.: 728,069

[22] Filed: Apr. 29, 1985

Related U.S. Application Data

[63] Continuation-in-part of Ser. No. 659,217, Oct. 10, 1984.

[30] Foreign Application Priority Data

Apr. 28, 1984 [JP] Japan ..... 59-87496

[51] Int. Cl.[4] ..... B65G 65/34

[52] U.S. Cl. ..... 414/416; 414/419; 414/786

[58] Field of Search ..... 414/403, 405, 413, 416, 414/419, 421, 422, 762, 764, 765, 766, 786; 53/381; 198/403, 347, 425

[56] References Cited

U.S. PATENT DOCUMENTS

| | | | |
|---|---|---|---|
| 2,473,955 | 6/1949 | Kendall | 414/762 |
| 3,263,842 | 8/1966 | Holstein | 414/416 X |
| 3,486,647 | 12/1969 | Seragnoli | 414/419 X |
| 3,550,799 | 12/1970 | Marradi | 414/421 X |
| 3,598,268 | 8/1971 | Wallace | 414/413 |
| 3,774,791 | 11/1973 | Bornfleth | 414/421 |
| 3,861,543 | 1/1975 | Elsworth | 414/403 |
| 4,303,366 | 12/1981 | Hinchcliffe et al. | 414/419 |
| 4,482,282 | 11/1984 | Wildmoser | 414/417 X |
| 4,530,633 | 7/1985 | Lodi et al. | 414/421 X |

FOREIGN PATENT DOCUMENTS

| | | |
|---|---|---|
| 48-34919 | 10/1973 | Japan . |
| 56-52880 | 12/1981 | Japan . |
| 57-28640 | 6/1982 | Japan . |

*Primary Examiner*—L. J. Paperner
*Assistant Examiner*—Stuart J. Millman
*Attorney, Agent, or Firm*—David A. Jackson

[57] ABSTRACT

A method and apparatus for supplying bar-like members such as cigarettes and filter plugs, in which a bar-like member containing box is lifted at a supplying position which supports the containing box in an inverted condition; and a pusher is operated to feed the bar-like members instead of a conventional hopper construction which stores bar-like members and allows them to drop from same, whereby the speed of the supplying operation is increased and a smooth supplying operation is assured without causing disordered orientation of the bar-like members.

12 Claims, 17 Drawing Figures

BAR-LIKE MEMBER SUPPLYING METHOD AND DEVICE

REFERENCE TO RELATED APPLICATION

This application is a Continuation-In-Part Application of commonly assigned U.S. patent application Ser. No. 06/659,217, filed Oct. 10, 1984, by the inventors herein, entitled "Method and Apparatus for Feeding Bar-Like Materials".

BACKGROUND OF THE INVENTION

This invention relates to a method and apparatus for supplying bar-like members and, in particular, bar-like members such as cigarettes and filter plugs.

In conventional supplying methods, as disclosed in Japanese Examined Pat. Publication No. 48-34919, and Japanese Examiner Utility Model Publication Nos. 56-52880 and 57-28640, a bar-like member containing box is placed in an inverted condition above a hopper disposed on a horizontally extending belt conveyor, and bar-like members are naturally dropped from an opening in the bottom of the box into a hopper, so that they may be supplied from the hopper onto a belt conveyor.

With such conventional methods, however, since the supplying action is attained by the natural dropping of the bar-like members from the containing box, it is difficult to speed-up the supplying operation, whereby greatly increasing the quantity of supplied bar-like members is not expected.

Further, the bar-like members are supplied from an opening in the bottom of a containing box to an accumulating surface of bar-like members already stored in the hopper. Since such an accumulating surface presents an unevenness, some of the bar-like members dropping from the containing box may be caught by the convex portions of the surface, or may be rolled obliquely into concave portions of the stack in the hopper resulting in disordered orientation of bar-like members, that is, inclined with respect to the vertical direction. Accordingly, conventional methods are defective in that they cannot assure a smooth supplying operation.

OBJECTS AND SUMMARY OF THE INVENTION

It is an object of the present invention to provide a method and apparatus which eliminates the defects of conventional methods as described above.

It is another object of the present invention to provide a method and apparatus which speeds up the supply and assures a smooth supply operation without causing disordered orientation, of the bar-like members.

It is still another object of the present invention to provide a method and apparatus in which a bar-like member containing box is lifted at a supplying position in an inverted condition, and then a pusher is operated to feed the bar-like members which fall from the containing box into an accumulating device in a lump instead of a conventional hopper construction which stores bar-like members therein and allows them to drop therefrom.

According to an aspect of the present invention, there is provided a method for supplying bar-like members from a containing box opened at the top and thereof to an entrance side of an accumulating device, comprising the steps of: moving the containing box to an inverted position; lifting the containing box at a supplying position which is located on an entrance side of an accumulating device to allow bar-like members within the containing box to be supplied to the supplying position; and feeding said bar-like members in a lump in a direction perpendicular to the longitudinal direction of the bar-like members into the accumulating device by pusher means.

According to another aspect of the invention, there is provided an apparatus for supplying bar-like members from a containing box opened at the top end thereof to an entrance side of an accumulating device, comprising: a bar-like member supplying path located adjacent the entrance side of the accumulating device; a box delivering mechanism located adjacent the supplying path for placing the containing box in an inverted condition onto the supplying path; a box lifting mechanism located adjacent the supplying path for lifting the containing box to allow the bar-like members within the containing box to be supplied to the supplying path; a pusher mechanism located adjacent the supplying path for pushing the bar-like members supplied to the supplying path into the accumulating device in a lump; and an empty box discharging mechanism located adjacent the supplying path for discharging the containing box thus lifted from the supplying path.

The above, and other, objects, features and advantages of the present invention will be readily apparent from the following detailed description thereof which is to be read in connection with the accompanying drawings.

DETAILED DESCRITPION OF THE PREFERRED EMBODIMENTS

Figures 1, 1A:
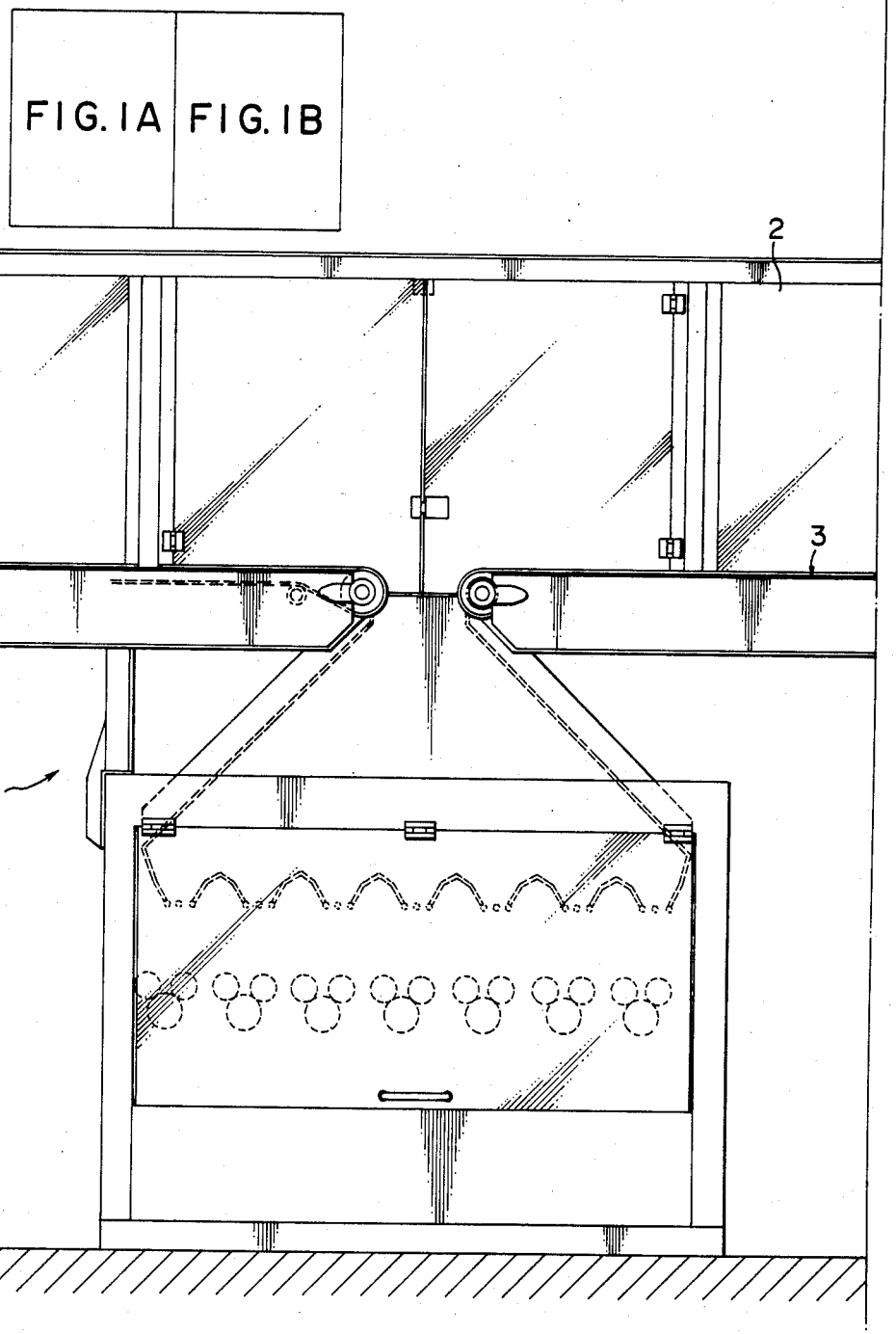
FIG. 1 is a front elevational view of a bar-like member supplying apparatus according to the present invention.

The present invention will now described in detail in connection with an embodiment which is applied to a containing box made of corrugated cardboard for containing filter plugs therein. The present invention is similar to and constitutes an improvement on the invention of the aforementioned copending U.S. patent application Ser. No. 06/659,217, the entire disclosure of which is incorporated herein by reference. The containing box a made of corrugated cardboard is in the form of a box open at its front side and having an upper lid a-1 mounted at the upper face thereof for opening and closing movement so as to allow plugs m to be contained in box a. Alternately, the containing box may be a metal tray. Also, the opening at the top of the box may be formed originally in the box or may be opened by opening an upper lid.

Referring to the drawings in detail, and initially to FIGS. 1 to 4, a supplying device A of the apparatus generally includes a supplying station 10 supplied with a plug containing box a, a box delivering mechanism b, a box lifting mechanism c, a pusher mechanism d, and an empty box discharging mechanism e.

The supplying station 10 is located adjacent an entry end of an accumulating device 2 of a plug conveying machine B and forms a supplying path 10'. The supplying path 10' includes a movable bottom section 12 formed by extensions of two belt conveyors 11 constituting a movable floor 3 of the accumulating device 2, and a movable back plate 13 forming a back wall for the movable bottom section 12. The back plate or back wall 13 includes part of a turning frame which will be hereinafter described.

The movable bottom section 12 may alternatively be constructed from a belt conveyor separate from belt conveyors 11 of the accumulating device 2, or from a securely fixed planar bottom plate without using a belt conveyor.

The movable back plate 13 is provided on a machine frame 1 and is moved forwardly and backwardly by a drive mechanism 15 which is driven from a driving source formed from an air cylinder 14. In the forwardly moved position, the movable back plate 13 constitutes the back wall for the supplying path 10'.

The box delivering mechanism b is located at the front side of the supplying path 10' and includes a lifter 20, a pressing arm 24 and a turning frame 26.

The lifter 20 includes a pair of left and right lifting chains 21 and 21' which circulate in the vertical direction. The lifting chains 21 and 21' are located in a spaced relationship by a distance substantially equal to the width of the containing box a, and have lifting plates 22 and 22' projected in an opposing relationship therefrom, respectively.

Located adjacent a lower end of the lifter 20 is an introduction conveyor 23' for transporting containing boxes a one at a time from a transporting path 23. The conveyor 23' is located adjacent the lower end of and between left and right chains 21 and 21' and extends in a forward and rearward horizontal direction so as to carry containing boxes a one after another to a position under lifter 20.

Lifter 20 is operable to engage and lift upwardly lifting plates 22 and 22' thereof, along with containing boxes a carried in by conveyor 23'.

The pressing arm 24 is integrally suspended from a chain 24' which is provided on the machine frame 1 and moved forwardly and backwardly. A pressing plate 25 is integrally provided at the lower end of pressing arm 24, extends over the perpendicular to lifter 20 and is moved forwardly and backwardly.

Pressing arm 24 is moved back and forth after lifting plates 22 and 22' of lifter 20 have been moved upwardly and then stopped at the upper limit position thereof. When pressing plate 25 advances, that is, moves rearwardly, it presses a containing box a out toward turning frame 26.

The turning frame 26 is mounted for reciprocal rotation by an angle of 180 degrees about a rotary shaft 27 located between lifter 20 and supplying path 10'.

The turning frame 26 has a back plate 28, a bottom plate 29 located on the bottom of containing box a in the inverted position of turning frame 26 and projected on the upper edge of back plate 28, and top pushing plates 30 located on the top of containing box a in the inverted position of turning frame 26 and projected on the lower edge of back plate 28. Thus, the turning frame 26 has a generally channel-formed configuration.

Turning frame 26 has a normal position (FIG. 1) in which an inner face of back plate 28 opposes pressing plate 25 and an inverted position which is the reverse of the normal position. In the normal position of turning frame 26, top pushing plates 30 are positioned in opposition to and are level with lifting plates 22 and 22' of the lifter 20, while the lifting plates are in the upper limit position. In the inverted position, bottom plate 29 is positioned directly above movable bottom section 12 of supplying path 10', and back plate 28 forms a front wall of the supplying path 10'.

A bridging plate 31 extends between top pushing plates 30 of turning frame 26 in the normal position and lifting plates 22 and 22' in the upper limit position to provide a bridge therebetween for smooth transition. During such movement from lifting plates 22 and 22' and pushing plates 30, an abutting rod 31' opens an upper lid a-1 of containing box a.

Figure 5:
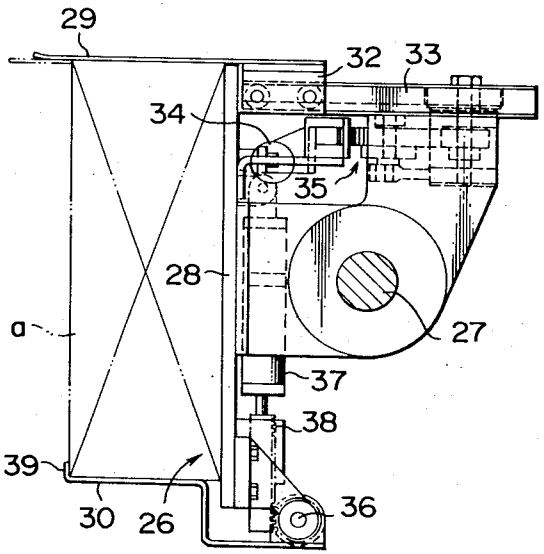
FIG. 5 is an enlarged elevational view of a turning frame shown in FIG. 3.
Figure 4:
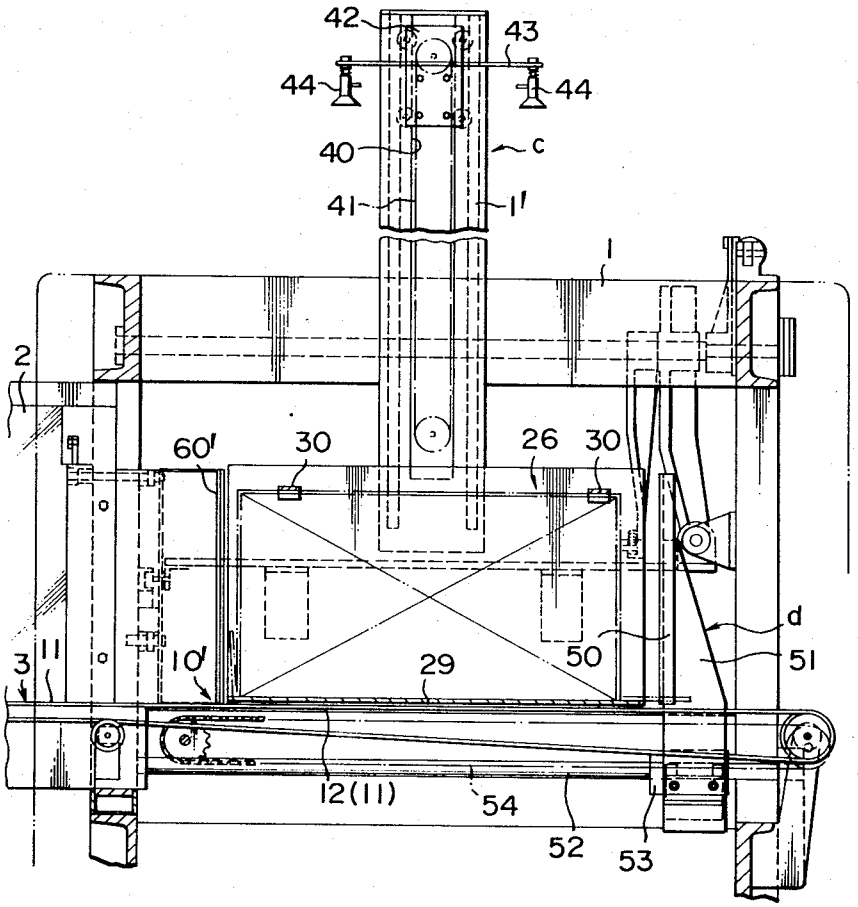
FIG. 4 is a schematic cross-sectional view, in an enlarged scale, taken along line IV—IV of FIG. 3.
Figure 6:
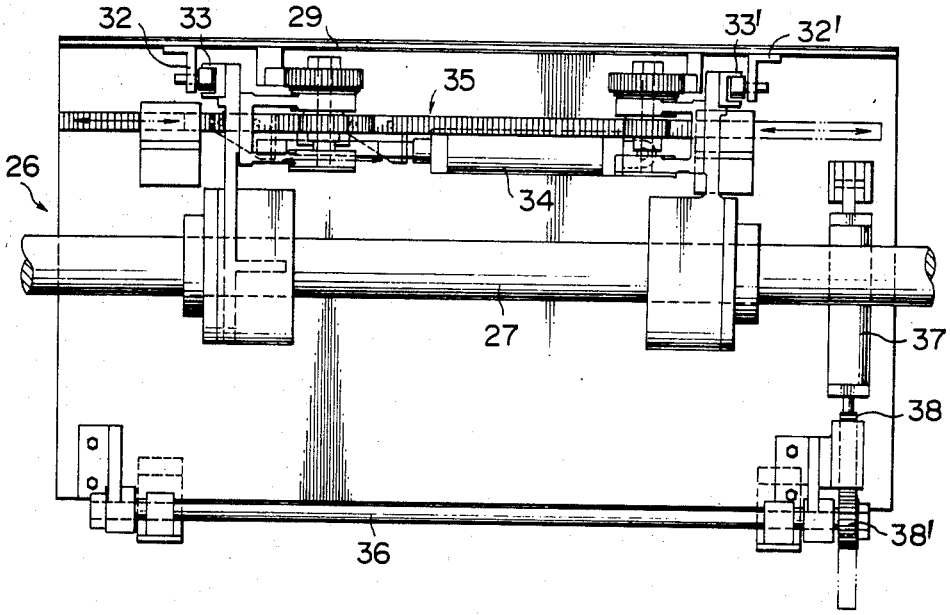
FIG. 6 is a side elevational view of the turning frame of FIG. 5.

As shown in FIG. 5, bottom plate 29 includes supporting members 32 and 32' adapted to roll along guide rails 33 and 33', respectively, which are mounted on the rear face of back plate 28 as as to allow bottom plate 29 to move below the front face of back plate 28. A transmission mechanism 35 including a rack driven by an air cylinder 34, a pinion, a gear and the like, are connected to supporting members 32 and 32' so as to attain such movement of bottom plate 29 described above, as shown in FIG. 6.

Figure 7:
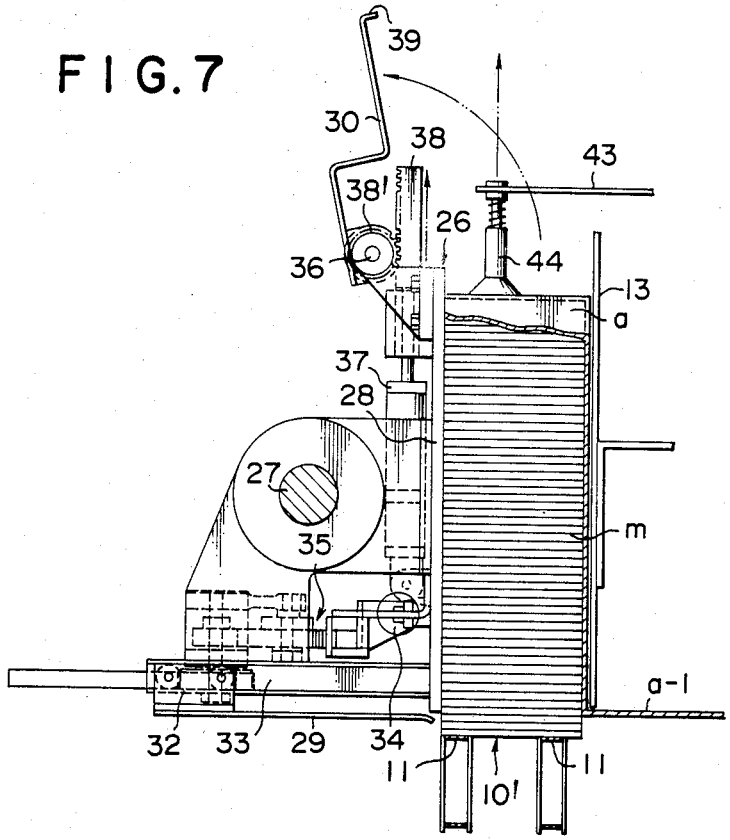
FIG. 7 is a side elevational view showing the turning frome of FIG. 5 in its inverted position and a bottom plate and a top push rod in respective pivoted open positions.
Figure 9:
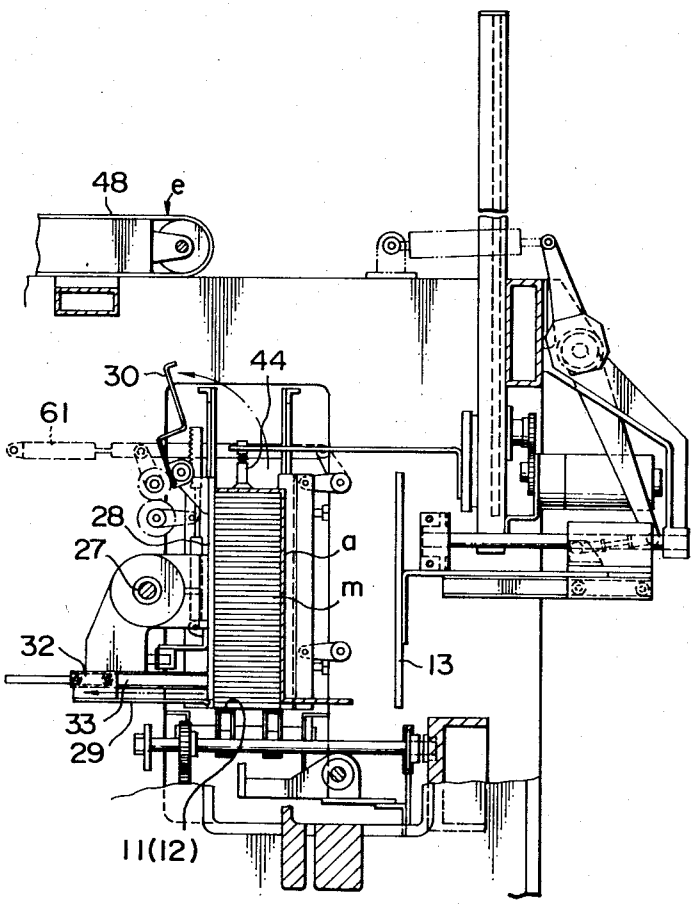
FIG. 9 is a side elevational view similar to FIG. 8 of a portion of the apparatus, illustrating a further aspect of the operation for supplying bar-like member to a supply path.
Figure 8:
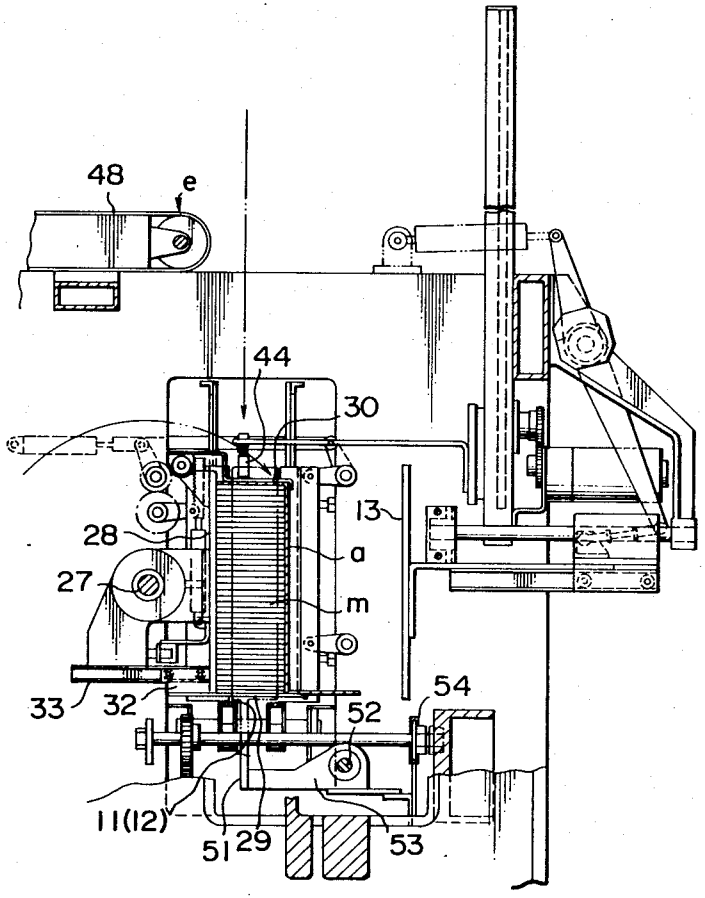
FIG. 8 is a side elevational view partly fragmentary and partly in phantom of a portion of the apparatus, illustrating an aspect of the operation for supplying bar-like members to a supply path.

Top pushing plates 30 are mounted for pivotal motion about a support shaft 36 adjacent back plate 28, and support shaft 36 is driven through an air cylinder 37, a rack 38 and a pinion 38', as shown in FIG. 7. Top pushing plates 30 each have a latching claw 39 for latching the containing box a mounted thereon.

In the box delivering mechanism b, the containing box a which has moved to the upper limit position by the lifter 20 is pushed into the channel-shaped spacing of the turning frame 26 as pressing plate 25 advances. Then, after latching claws 39 are projected to latch the lower end of containing box a, turning frame 26 is rotated by an angle of 180 degrees to the reserve or inverted position to deliver the containing box a thereat.

Thus, containing box a is fed from transporting path 23 with its upper lid a-1 opened slightly onto conveyor 23'. Then, box a is lifted by lifting plates 22 and 22', and as it is pushed toward turning frame 26 by pressing plate 25, the upper lid a-1 thereof abuts and is opened by abutting rod 31' so that containing box a will be held in turning frame 26 with its upper side opened. In this position, the open front side of containing box a is contacted with and covered by back plate 28. Frame 26 is then inverted 180 degrees so that containing box a is held in its inverted position in turning frame 26.

Figure 1B:
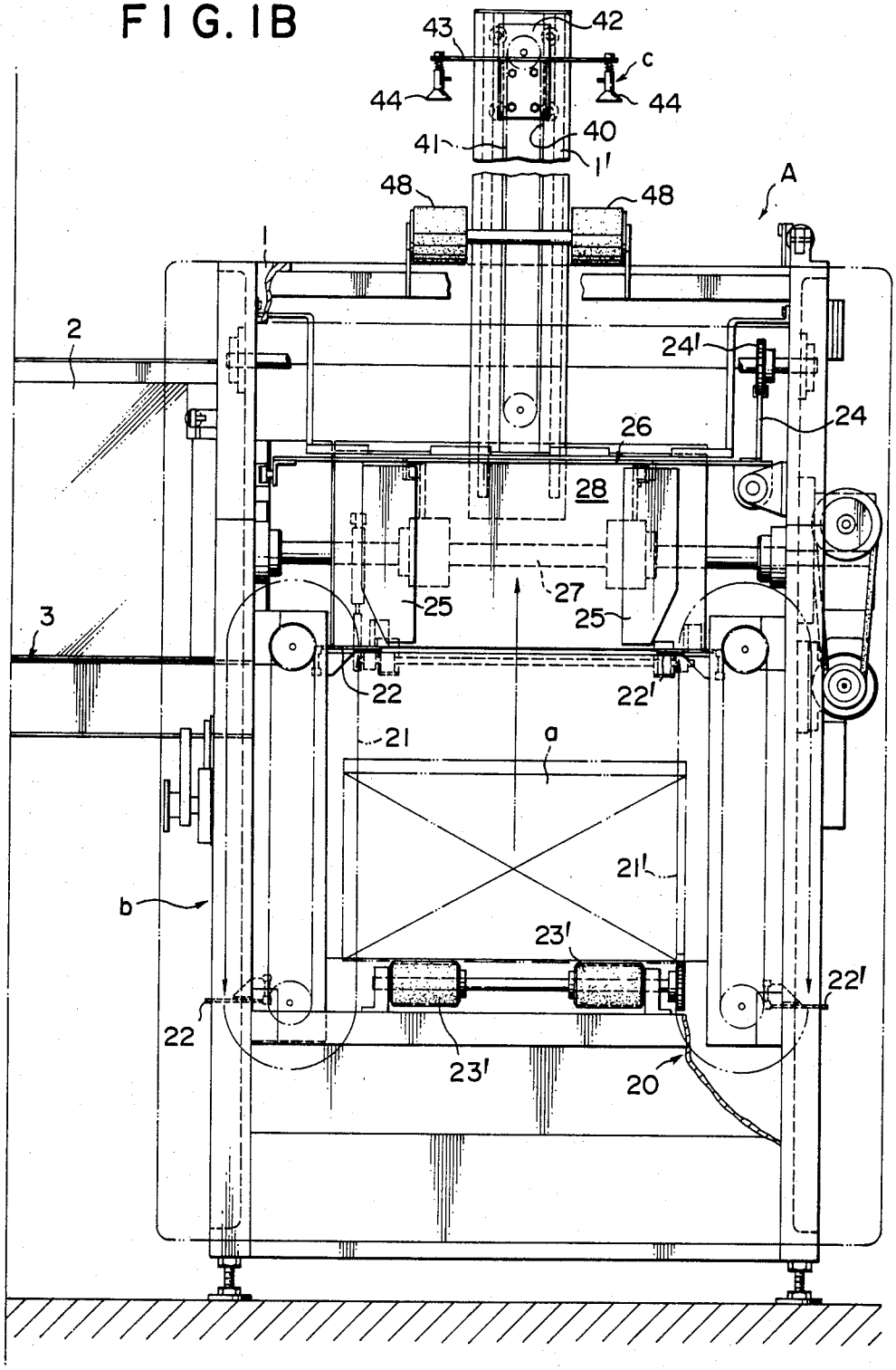
Figure 2A:
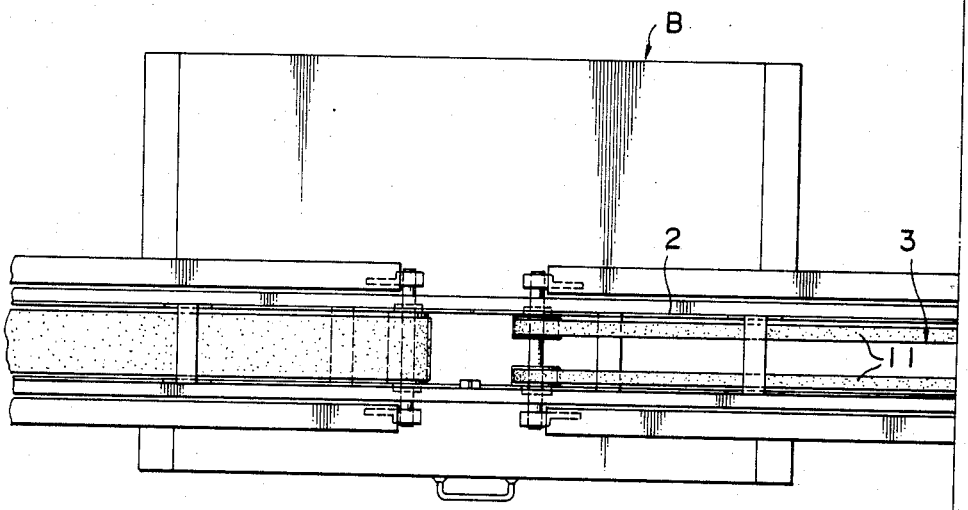
FIG. 2 is a top plan view of the apparatus of FIG. 1.
Figure 2:
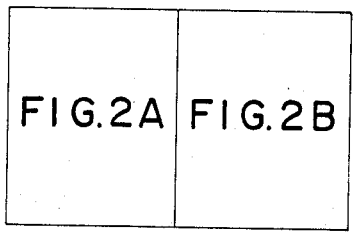
Figure 2B:
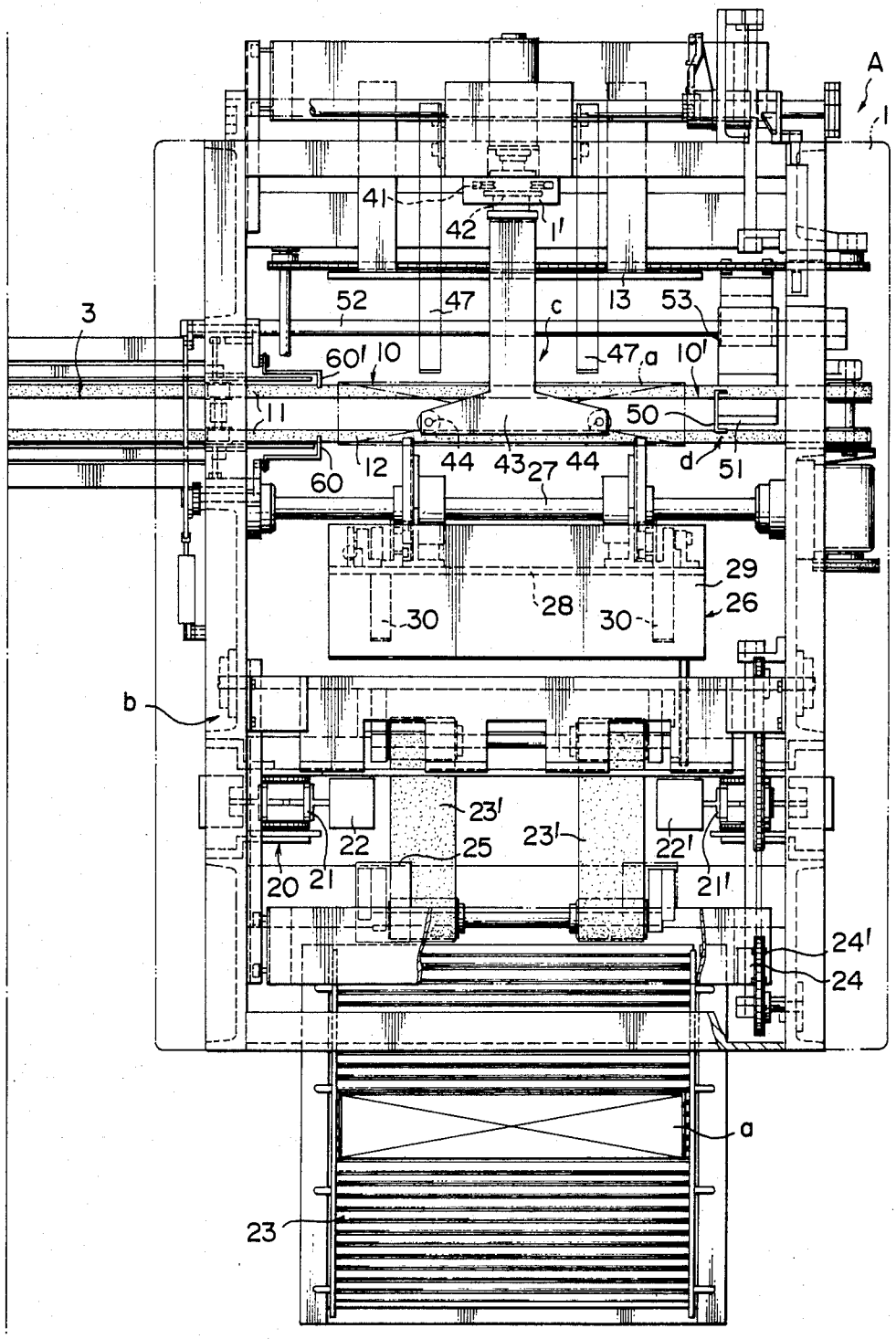

The box lifting mechanism c is installed on a frame 1' which is erected to the rear of supplying path 10'. Frame 1' has a guide path 40 formed to extend upwardly therein, and an endless chain 41 is mounted to circulate in the vertical direction in guide path 40, as shown in FIG. 1B. A lifting element 42 is mounted for vertical movement on frame 1' and engages with endless chain 41 so as to be moved in the vertical direction thereby.

Lifting element 42 has a box lifting arm 43 provided thereon. Box lifting arm 43 has opposite left and right ends thereof which extend above supplying path 10' and which include attracting or suction elements 44 mounted at opposite extremities thereof. Suction elements 44 provide a suction action at their bottom ends by means of a vacuum for engaging and lifting containing box a. Such attracting or suction action is started and stopped at suitable points of time. In particular, suction pads 44 move vertically together with lifting element 42, and abut with and attract, at a lower limit position thereof, the top face of containing box a at supplying station 10. Then, as suction elements 44 move upwardly, they lift containing box a to an upper limit position with box a attracted and held thereto.

While containing box a is being lifted, the plugs m within box a are discharged from the opened bottom side of box a and supplied into turning frame 26 until containing box a becomes empty. The plugs m are then transferred onto supplying path 10'.

When suction elements 44 move downwardly, back plate 13 associated with supplying path 10' is also moved forwardly to form a rear wall, and before the suction elements 44 begin to move in the vertical direction, bottom plate 29 and top pushing rod 30 are moved to an open or non-obstructing position.

Figure 13:
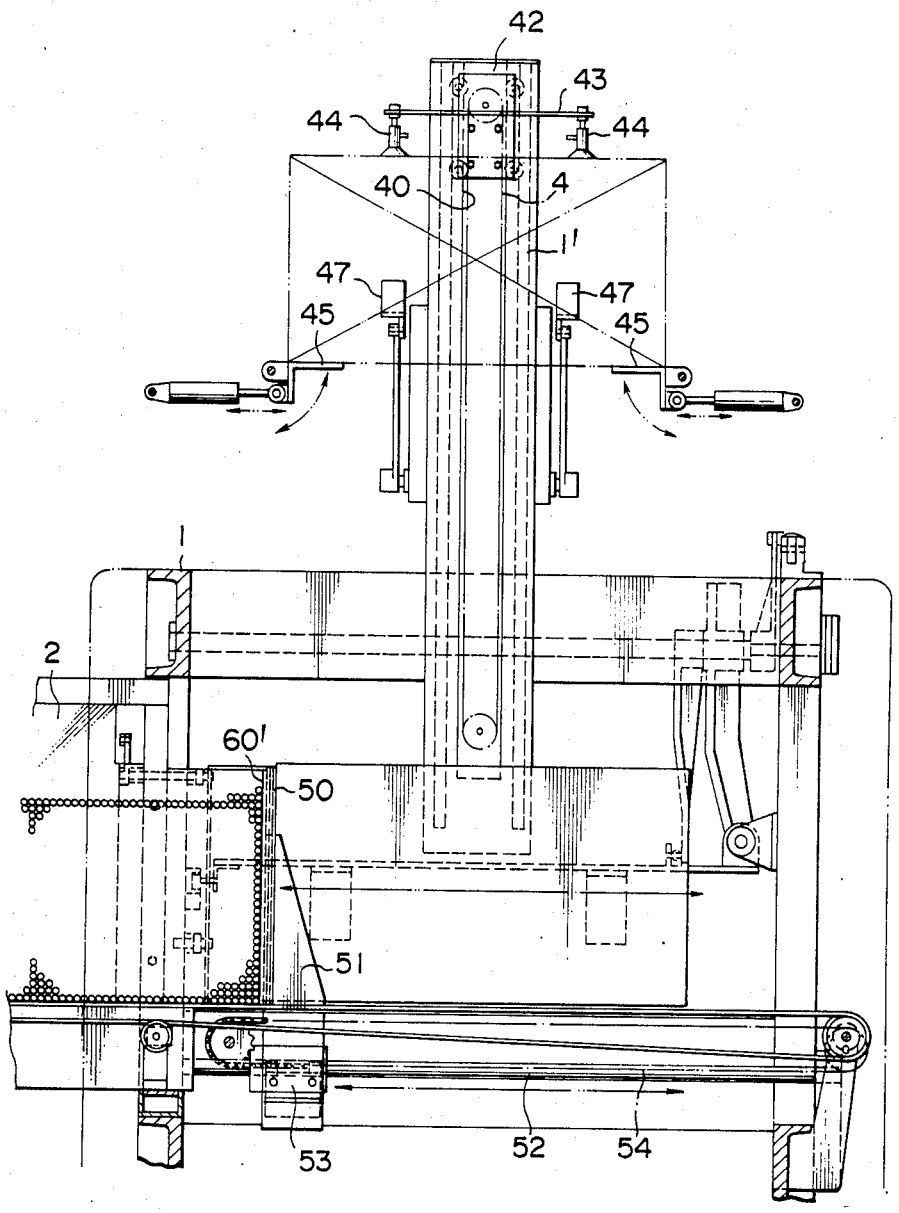
FIG. 13 is an elevational view of a portion of the apparatus, illustrating an operation for transporting and supplying bar-like members to an accumulating device from the supply path.

In a lower part of the box lifting mechanism c, box supports 45 are mounted for opening and closing motion, and while box supports 45 are in their closed position, they can receive thereon the empty box lifted thereto by mechanism c, as shown in FIG. 13.

Figure 3:
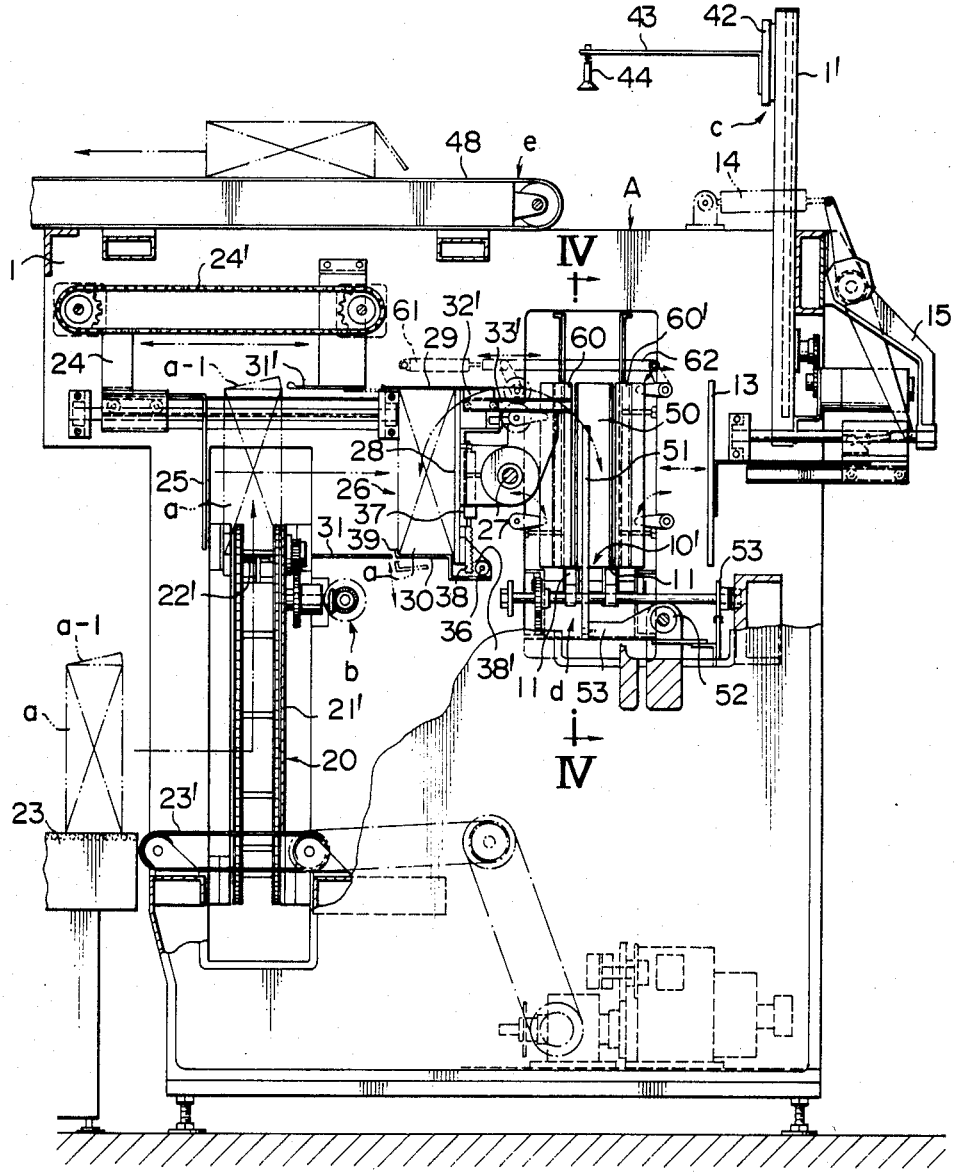
FIG. 3 is a right hand side elevational view of the apparatus of FIG. 1.
Figure 10:
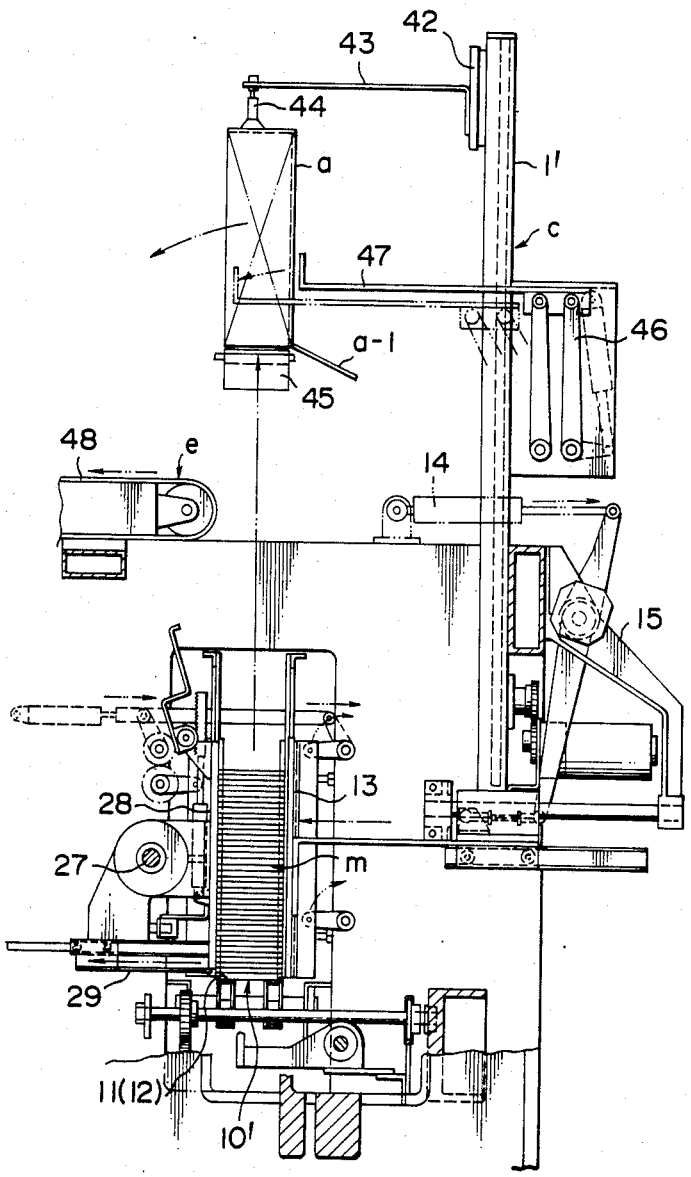
FIG. 10 is a side elevational view partly in phantom of a portion of the apparatus, illustrating a further aspect of the operation for supplying bar-like member to a supply path.

The empty box discharging mechanism e includes pusher arms 46 mounted for reciprocable rocking motion behind frame 1', and pusher hands 47 extending horizontally forward from the upper ends of pusher arms 46, as shown in FIG. 10. In front of the machine frame 1, a belt conveyor 48 is located to extend forwardly on top of machine frame 1 in an opposing relationship to pusher hands 47, as shown in FIG. 3.

In the discharging mechanism e, the empty box lifted to supplying station 10 by suction elements 44 of box lifting mechanism c, is pushed out forwardly and discharged onto belt conveyor 48 by the forwardly moving pusher hands 47. It is to be noted that just before pusher hands 47 begin their operation, the vacuum to suction elements 44 is discontinued, to allow the empty box to be transferred onto box supports 45.

Figure 12:
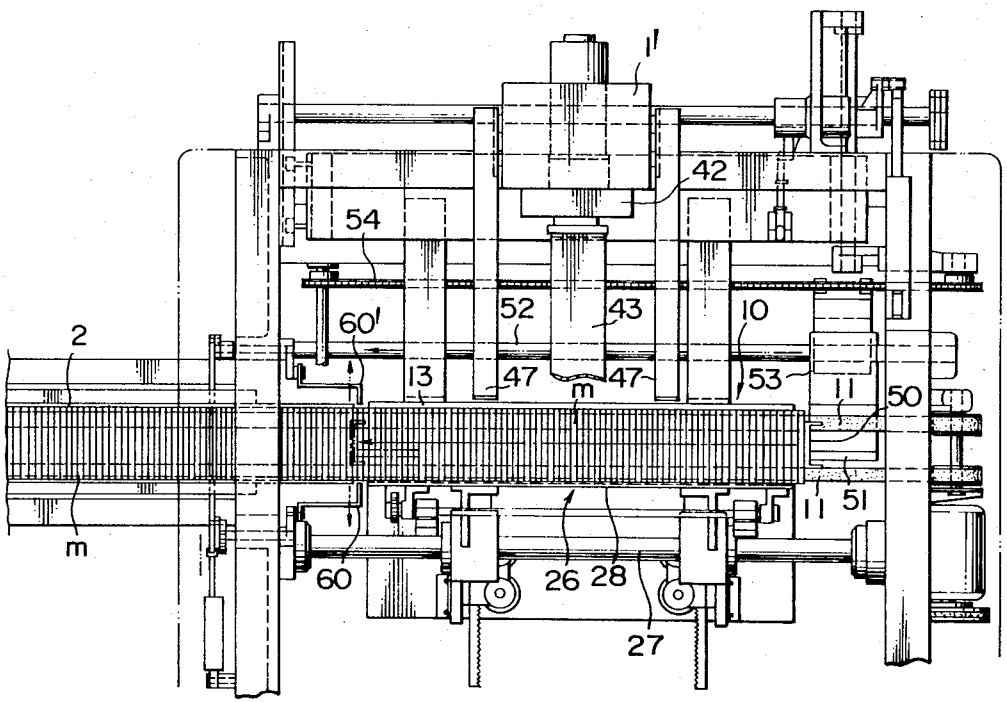
FIG. 12 is a top plan view showing the bar-like members supplied to the supply path.

The pusher mechanism d includes a pusher 50 in the form of a flat plate having a width slightly smaller than the length of a plug m and a height substantially equal to the height of a containing box a. Pusher 50 is mounted for movement toward and away from the accumulating device 2 along supplying path 10'. As shown in FIGS. 12 and 13, the pusher mechanism d further includes an arm rod 51 connected in integral relationship to pusher 50 and extending downwardly therefrom, a movable element 53 connected to a lower end of arm rod 51 and movable along supplying path 10' under the guidance of a guide rod 52, and a chain conveyor 54 for reciprocally moving movable element 53 within a predetermined section.

The arm rod 51 of pusher 50 is located between the two belt conveyors 11 constituting the movable bottom 12 of supplying path 10' so as to allow reciprocal motion thereof without interfering with the belt conveyors 11. The chain conveyor 54 is driven intermittently such that it is circulated at the same speed as belt conveyors 11 when pusher 50 is advanced.

The pusher mechanism d is rendered operative after the box lifting mechanism c has been operated to lift a containing box a to allow plugs m to be dropped and supplied onto the supplying path 10'. Then, pusher 50 pushes plugs m together on the belt conveyors 11 of the supplying path 10' to feed them to the entrance of the accumulating device 2.

Figure 11:
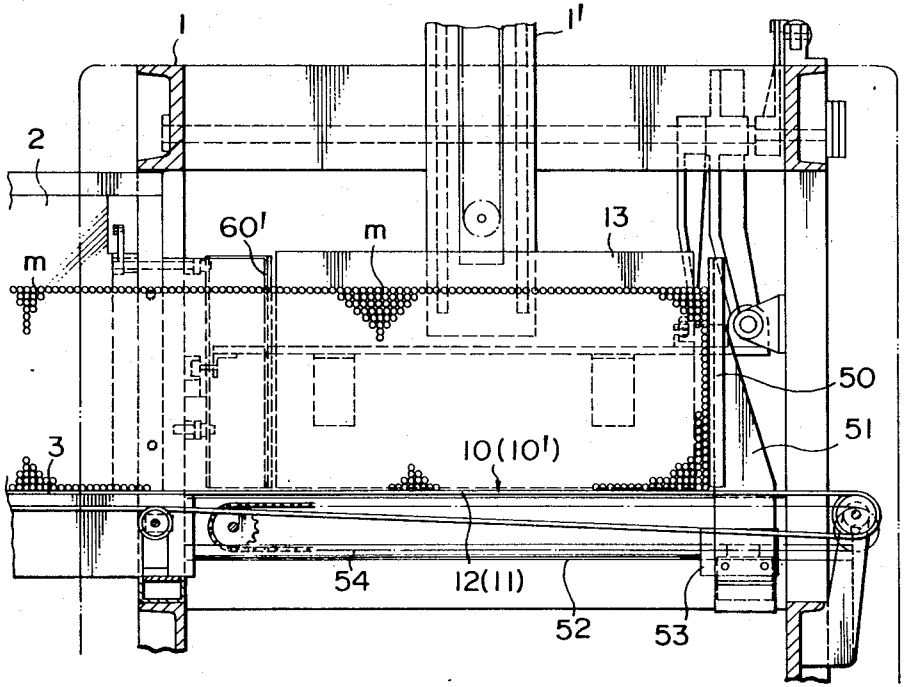
FIG. 11 is a front elevational view of a portion of the apparatus, showing bar-like members supplied to the supply path.

At the entrance end of accumulating device 2, shutters 60 and 60' are mounted for opening and closing motion above the supplying path 10', as shown in FIGS. 11 and 12. Shutters 60 and 60' are in the form of vertical walls entending uprightly in forwardly and rearwardly opposed relationship above the supplying path 10'. In the closed positions of shutters 60 and 60', the distance between them is a little greater than the width of pusher 50 and a little smaller than the length of a plug m, and in the open positions of shutters 60 and 60', the distance between them is a little greater than the length of a plug m.

Shutters 60 and 60' are connected to a parallel link mechanism 62, shown in FIG. 3, which is operated by an air cylinder 61 so that they may be opened to increase the distance between them while they are moved upwardly and may be closed to decrease the distance between them while they are moved downwardly. In the open position of shutters 60 and 60', pusher 50 feeding plugs m passes between shutters 60 and 60' and enters a little into accumulating device 2. After shutters 60 and 60' have been closed, pusher 50 is returned, passing between shutters 60 and 60'. Plugs m carried in into the accumulating device 2, however, are prevented from rolling out to the supplying path 10' by the side walls formed by shutters 60 and 60' in the closed positions.

Thus, a containing box a which has been inverted on the supplying path 10' by turning frame 26, is lifted by the box lifting mechanism c after bottom plate 29 of turning frame 26 has been pulled open. During this lifting movement of containing box a, plugs m within containing box a are dropped onto the movable bottom of the supplying path 10' through turning frame 26. By means of belt conveyors 11 and pusher 50, which are then rendered operative, plugs m on the supplying path 10' are transported in a lump into the accumulating device 2, passing through shutters 60 and 60'.

Then, either while pusher 50 is stopped temporarily within the accumulating device 2 or after pusher 50 has returned to its initial position, movable back plate 13 is returned away from the supplying path 10'. Turning frame 26 is then returned to its normal position to allow a new containing box a to be carried onto turning frame 26. Thus, similar operations to those as described hereinabove will be repeated at suitable points of time.

Figure 14:
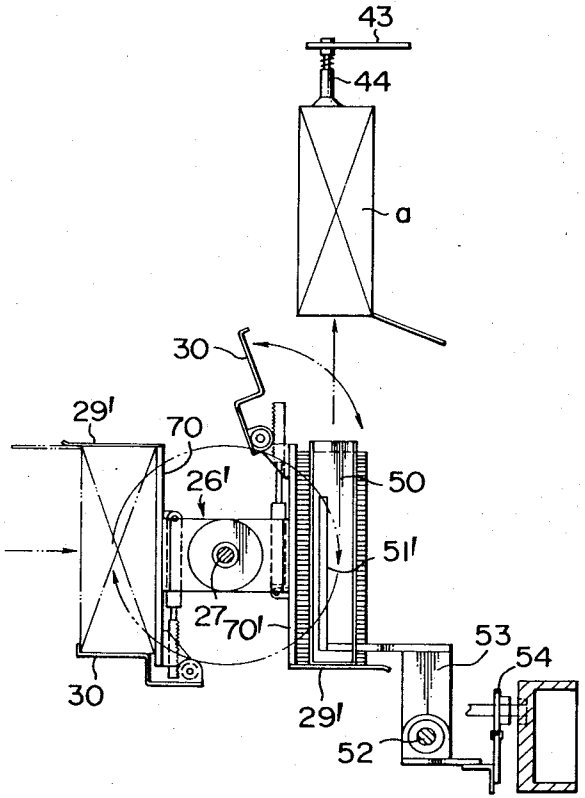
FIG. 14 is a side elevational view showing a variation of the bar-like member supplying apparatus according to the invention.

Referring now to FIG. 14 which illustrates a modified form of the device according to the present invention, movable bottom section 12 of the supplying path 10' as described hereinabove is omitted, and a bottom section of the supplying path 10' is formed by a fixed bottom plate 29' of turning frame 26'. Bottom plate 29' is mounted level with the belt conveyors 11 within the accumulating device 2.

Further, the movable back plate 13 as described above is omitted, and an arm rod 51' of pusher 29' extends rearwardly around bottom plate 29' and communicates with movable element 53.

By this construction, the movable bottom section 12 is omitted, and the turning frame 26' can rotate by an angle of 360 degrees. Accordingly, turn-over frames 70 and 70' having a channel-formed configuration can be disposed in opposing relationship, resulting in an increase in operating speed.

Having described specific preferred embodiments of the invention with reference to the accompanying figures, it is to be appreciated that the present invention is not limited by the precise embodiments, and that various changes and modifications may be effected by one of ordinary skill in the art without departing from the scope and spirit of the invention as defined by the appended claims.

What is claimed is:

1. A method for supplying bar-like members from a containing box opened at the top end thereof to an entrance side of an accumulating device, comprising the steps of:

moving the containing box to an inverted position;

removing the bar-like members from the containing box by lifting the containing box at a supplying position which is located on an entrance side of an accumulating device to allow bar-like members within the containing box to be supplied to the supplying position;

feeding said bar-like members in a lump in a direction perpendicular to the longitudinal direction of the bar-like members into the accumulating device by pusher means after the bar-like members have been removed from the containing box; and temporarily closing the entrance end of the accumulating device after the bar-like members have been fed into the accumulating device.

2. Apparatus for supplying bar-like members from a containing box opened at the top end thereof to an entrance side of an accumulating device, comprising:

a bar-like member supplying path located adjacent the entrance side of the accumulating device;

a box delivering mechanism located adjacent the supplying path for placing the containing box in an inverted condition onto the supplying path;

a box lifting mechanism located adjacent the supplying path for lifting the containing box to allow the bar-like members within the containing box to be removed from the containing box and supplied to the supplying path;

a pusher mechanism located adjacent the supplying path for pushing the removed bar-like members supplied to the supplying path into the accumulating device in a lump;

means for temporarily closing the entrance end of the accumulating device after the bar-like members have been supplied to the accumulating device; and an empty box discharging mechanism located adjacent the supplying path for discharging the containing box thus lifted from the supplying path.

3. A bar-like member supplying apparatus according to claim 2, wherein said box delivering mechanism includes a turning frame for receiving and supporting thereon said containing box in a normal condition and for bringing said containing box into an inverted condition on said supplying path.

4. A bar-like member supplying apparatus according to claim 3, wherein said turning frame has a bottom plate which can be opened and closed at an inverted position of said turning frame, and said supplying path has at least a bottom section.

5. A bar-like member supplying apparatus according to claim 3, wherein said turning frame has a bottom plate which is fixed at an inverted position of said turning frame, and a bottom section of said supplying path is formed by said bottom plate.

6. A bar-like member supplying apparatus according to claim 2, wherein said means for temporarily closing includes at least one shutter movable between an open and closed position with respect to the supplying path, at the entrance end of the accumulating device; and means for moving said at least one shutter between said open and closed positions.

7. A bar-like supplying apparatus according to claim 6, wherein said means for temporarily closing includes first and second shutters mounted above and at opposite sides of the supplying path for movement between said open and closed positions; and said means for moving includes parallel link means connected to said first and second shutters for moving the same in synchronism between said open and closed positions, and actuating means for controlling said parallel link means to move said first and second shutters between said open and closed positions.

8. A bar-like supplying apparatus according to claim 7, wherein said actuating means includes a pneumatically operated cylinder.

9. A bar-like supplying apparatus according to claim 2, wherein said pusher mechanism includes a pusher plate having a width slightly less than the length of said bar-like members and a height at least substantially equal to the height of said containing box.

10. A bar-like supplying apparatus according to claim 9, wherein said pusher mechanism includes a pusher plate for pushing the removed bar-like members supplied to the supplying path into the accumulating device; and means for moving the pusher plate toward and away from the accumulating device.

11. A bar-like supplying apparatus according to claim 10, wherein said means for moving includes a guide rod, means for slidably connecting said pusher plate to said guide rod, and means for reciprocally moving said pusher plate along said guide rod.

12. A bar-like supplying apparatus according to claim 11, wherein said means for reciprocally moving includes a chain conveyor connected with said means for slidably connecting.

* * * * *